US005553381A

United States Patent [19]

Lehtonen

[11] Patent Number: 5,553,381

[45] Date of Patent: Sep. 10, 1996

[54] METHOD FOR COATING A ROLL OF A PAPER MACHINE

[75] Inventor: Pentti Lehtonen, Jyväskylä, Finland

[73] Assignee: Valmet Corporation, Helsinki, Finland

[21] Appl. No.: 302,530

[22] Filed: Oct. 17, 1994

Related U.S. Application Data

[62] Division of Ser. No. 14,652, Feb. 8, 1993, abandoned.

[30] Foreign Application Priority Data

Feb. 6, 1992 [FI] Finland ..... 920501

[51] Int. Cl.[6] ..... B23P 15/00

[52] U.S. Cl. ..... 29/895.32; 492/53; 492/56

[58] Field of Search ..... 492/53, 56, 59; 29/895.32, 895; 427/447

[56] References Cited

U.S. PATENT DOCUMENTS

| | | | |
|---|---|---|---|
| 3,958,097 | 5/1976 | Fabel et al. | 219/121 |
| 3,962,486 | 6/1976 | Gerek et al. | 427/34 |
| 4,999,225 | 3/1991 | Rotolico et al. | 427/423 |
| 5,023,985 | 6/1991 | Salo et al. | 29/132 |

FOREIGN PATENT DOCUMENTS

| | | |
|---|---|---|
| 0282310 | 9/1988 | European Pat. Off. . |
| 1261787 | 2/1968 | Germany . |
| 3527912 | 2/1987 | Germany . |

*Primary Examiner*—Irene Cuda

*Attorney, Agent, or Firm*—Steinberg, Raskin & Davidson P.C.

[57] ABSTRACT

A roll and a method for coating a roll in a paper machine with powder of thermo-plastic and/or specialty plastic. The coating is carried out by spraying by using hyper-sonic plasma.

14 Claims, 3 Drawing Sheets

METHOD FOR COATING A ROLL OF A PAPER MACHINE

This is a division, of application Ser. No. 08/014,652, filed Feb. 8, 1993, abandoned.

BACKGROUND OF THE INVENTION

The invention relates to a method for coating a roll of a paper machine with a powder comprising a thermoplastic and/or specialty plastic and a roll manufactured by the method. Coated rolls are used for very different purposes and applications in paper machines during the paper-making process and in post-handling machines for paper. Among the applications for such coated rolls are, e.g., press rolls, suction rolls, soft rolls in calenders and super calenders and the like. Different quality requirements are desired for coating the roll in different applications and in different processes. Some conventional quality factors for the roll coating are its hardness at a given temperature, temperature resistance, press resistance, chemical resistance, surface smoothness, resistance against mechanical damages, elasticity, surface energy, loosing properties of the paper, conductivity, and non-ageing.

Conventionally rolls of paper machines have been coated with rubber, polyurethane or epoxy. These polymeric materials are especially suitable for coating large rolls of manufacturing for technical reasons. One- or two-component polyurethane and epoxy compounds are available ill fluid form in which case these compounds can be cast in a form or rotation casting. It is also very easy to mix these polymeric materials with different fillers and additives to obtain new properties for the coating material. In addition to the form and rotation casting, suitable manufacturing techniques (coating techniques) for the polyurethane and epoxy include extrusion, spraying, filament winding, tape winding, spun casting and different impregnated mats.

Epoxy (a thermo-setting plastic) and polyurethane (a thermo-setting plastic or an elastomer) are materials which are used as roll coatings because, in addition to manufacturing and technical advantages, such polymer materials have advantageous properties. For example, polyurethane has good dynamic and abrasion properties and epoxy has been providing corrosion properties. The properties of the epoxy are retained also at higher operating temperatures.

The use of thermo-setting plastics as roll coatings has mainly been restricted by the loss of the advantageous properties with increasing coating temperatures and by manufacturing problems (expressly with respect to the coating of large rolls). However, a significant development has occurred during the last 10 years with respect to thermo-setting plastics.

In FIG. 1, a classification of actual thermo-setting plastics is presented generally.

In the following Table 1, there is a list according to ISO 1043-1 of abbreviations and names for some polymers. It also includes possible homopolymers.

TABLE 1

| | |
|---|---|
| CA | Cellulose-acetate |
| CAB | Cellulose acetate butyrate |
| CN | Cellulose nitrate |
| CP | Cellulose propionate |
| EP | Epoxy or epoxide |
| MF | Melamine formaldehyde |
| PA | Polyamide (quality is expressed with numbers) |
| PAI | Polyamide-imide |
| PAN | Polyacrylnitrile |
| PB | Polybutene-1 |
| PBT | Polybutene terephtalate |
| PC | Polycarbonate |
| PCTFE | Polychlorotrifluorethene |
| PDAP | Polydiallyl phthalate |
| PE | Polyethene |
| PEI | Polyether-imide |
| PEK | Polyetherketone |
| PEEK + derivative | Polyetheretherketone |
| PES | Polyethersulfon |
| PET | Polyethenterephtalate |
| PF | Phenol formaldehyde |
| PFA | Perfluoroalcoxyalkane |
| PI | Poly-imide |
| PIB | Polyisobutene |
| PMI | Polymetakryl-imide |
| PMMA | Polymethylmethacrylate |
| PMP | Poly-4-methylpentene-1 |
| POM | Polyoxyrnethene or polyacetal |
| PP | Polypropene |
| PPE | Polyphenylenether, earlier polyphenylen oxide PPO |
| PPS | Polyphenylen sulfide |
| PS | Polystyrene |
| PSU | Polysulfone |
| PTEE | Polytetrafluoroethene |
| PUR | Polyurethane |
| PVC | Polyvinyl chloride |
| PVDC | Polyvinyliden chloride |
| PVDF | Polyvinyliden fluoride |
| PVF | Polyvinylfluoride |
| SI | Silicon |
| UF | Ureaformaldehyde |
| UP | Unsaturated polyester |

The group of specialty plastics are especially interesting. Typical properties for plastics belonging to this group have good temperature resistances (260° C.), good mechanical properties (which properties are retained even in high temperatures in spite of high tensile strengths and good hardness properties), retained elasticity and a low impregnation of water.

In Table 2, properties of the specialty plastic PEEKK are presented as a function of the temperature.

TABLE 2

| Temperature property | −40° C. | 23° C. | 80° C. | 120° C. | 150° C. | 220° C. | Unit |
|---|---|---|---|---|---|---|---|
| Tensile strength | 129 | 108 | 76 | 56 | 49 | — | $N/mm^2$ |
| Ultimate elongation | 4 | 6 | 6,5 | 9 | 10 | — | % |
| Tear strength | 109 | 86 | 69 | 55 | 48 | 35 | $N/mm^2$ |
| Tear elonga- | 30 | 28 | 100 | 124 | 128 | 142 | % |

TABLE 2-continued

| Temperature property | −40° C. | 23° C. | 80° C. | 120° C. | 150° C. | 220° C. | Unit |
|---|---|---|---|---|---|---|---|
| tion | | | | | | | |
| Tensile-E-Modulus | 4150 | 4000 | 3490 | 3340 | 3100 | 230 | $N/mm^2$ |
| Bending stress | 131 | 120 | 107 | 91 | 84 | 8 | $N/mm^2$ |
| Bending-E-Modulus | 3860 | 3640 | 3370 | 3120 | 3010 | 240 | $N/mm^2$ |
| Notch impact toughness (Charpy) | 9 | 9 | | | | | $mJ/mm^2$ |

The advantageous properties of the specialty plastics at high temperatures are based on the principle of the substitution of the conventional aliphatic bond with an aromatic bond. The specialty plastics afford properties which are suitable for roll coatings, for example, in paper machines, carton machines and paper refineries. They can be used either as reinforced plastics or not. However, the specialty plastics are thermo-plastics and their processing methods are typical for thermo-plastics. Specialty plastics are available in granulates from which such fabricates as films, discs, tubes and bars are manufactured by such processes as injection moulding and extrusion.

Thermo-plastics are also available in powder form, in which case possible manufacturing techniques include dispersion spraying, electrostatic powder spraying, fluidized bed coating, flame spraying, plasma spraying and rotormolding. Filament winding and tape winding are conventionally suitable manufacturing techniques for thermo-setting plastics. However, recently the use of these two techniques has been more common also for thermo-setting plastics. Thermo-setting plastics and also specialty plastics can thus be obtained in powder form.

Large rolls can be coated with plastic powder by processes such as the following:

1. Electrostatic spraying—This process is usually used for relatively thin coatings. The porosity of the coatings formed by this process is high. In this case, for specialty plastics, the pre-heating and post-heating temperatures of the roll body are high which is not advantageous with respect to the paper machine rolls (carton and paper ref.).
2. Fluidized bed coating—This process is, as in the case of the electrostatic spraying, usually used only for thin coatings having a high porosity. The pre-heating/post-heating temperatures of the roll bodies are high. Manufacturing problems are associated with this method.
3. Dispersion spraying—In this process, the plastic powder is in the form of a dispersion in some suitable solvent. The dispersion is sprayed onto a surface of a body. The solvent evaporates/is evaporated away such that a very thin coating film is left on the surface of the working piece which often requires further temperature treating. Another possibility is to mix the plastic powder among some one- or two -component polymer. When the one- or two- component polymer reacts, a matrix is formed in which the plastic powder is left.
4. Rotormoulding technique—This process is used to coat interior surfaces and therefore cannot be used for coating outer surfaces of rolls.
5. Flame spraying—This process presents problems as described in the following.

Only standard plastics (for example PE, EVA, PP) can, to some extent, be sprayed without pre-heating the working piece which may be a roll. However, these plastics are not suitable for roll coatings with precise technical requirements.

With respect to the process of flame spraying with a specialty plastic, in such a process the working piece must be heated to a temperature as high as possible when thick coatings are desired. However, the temperature can not exceed a given threshold at which the plastic will burn. Also, the roll construction can set a limit for the temperature above which the roll construction will be adversely affected. Working pieces with thin walls need a higher pre-heating temperature than compact pieces. It is especially difficult to flame spray pieces of different thicknesses.

In this process of flame spraying, the plastic coating is sprayed in layers. The effect of the pre-heating decreases considerably after the first spraying layer. The piece is cooled down as the temperature of the roll is not kept constant. Even if the temperature would be kept constant, the coating being formed would become an isolate when it thickens. Because of the differences in the cooling rates, the temperature differences are increased. Thus, the first plastic layer isolates the heat coming from the working piece which consequently limits the coating thickness.

In a situation where the coating is too thick, and in a plastic coating which lacks heat energy in the outer layer, the melt drops of the plastic separate. The construction of the roll coating thereby becomes worse, i.e. the inner strength is weak and the crystallization degree incorrect.

Similar difficulties also appear in connection with conventional plasma spraying. In conventional plasma spraying, the heat effect of the spraying is formed so that the electric energy forms an arc between a wolfram cathode and an annular copper anode. A gas, or gas mixture, is led to the arc which is strongly heated up so that the gas molecules disintegrate to atoms and the atoms further disintegrate to ions and electrons. Thus, the gas is converted to a plasma. Electric energy is transmitted to the gas (to the plasma) and raises its inner energy. This inner energy is utilized when melting plastic powders so that the powder is fed to the out-streaming plasma (FIG. 2) wherein it is plasticized. The plasma spray accelerates the melt drops with a high rate on the surface of the piece to be coated.

The temperature of the plasma spray is very high; between about 7000° C. and about 15000° C. Due to this high temperature, the thermal radiation of the plasma is also very high. Some advantages are obtained from this radiation energy when melting plastic powders as the radiation energy increases the temperature of the working piece. This is advantageous with respect to the polymerization and thus, with respect to the formation of the coating.

A drawback of conventional plasma spraying is that the temperature of the plasma flame is too high with respect to the plastic, and the plastic tends to oxidize. Further disadvantages of conventional plasma spray are the low flowing rate of the gas and that the heat effect of the flame is too low to keep the compact pieces warm. Generally the plastics of Table 3 (below) are sprayed with conventional plasma in a conventional plasma spraying system. In other words, specialty plastics are not used as the disadvantages of using such specialty plastics have not been overcome.

TABLE 3

A COMPARISON OF USUAL POWDERY COAT TYPES OF COATINGS

| | THERMO SETTING PLASTICS | | | | THERMO PLASTICS | | |
|---|---|---|---|---|---|---|---|
| | Epoxy | Polyester urethane | Polyester TGIC | Hybride | Acryl | Nylon | PVC |
| Application/ curing temperature °C. | 120–122 | 150–200 | 140–200 | 140–220 | 140–200 | 180–320 | 170–290 |
| Thickness of the film (1) | <1–12 | <1–3,0 | <1–4,0 | <1–4,0 | <1–3,0 | 4–12 | 10–20 |
| Hardness | HB-5H | HB-5H | HB-5H | H-2H | 2H-5H | | |
| Outer strength | – | + | + | – | + | + | 0 |
| Weather strength | – | + | + | – | + | + | – |
| QUV-strength | + | 0 | 0 | – | + | 0 | 0 |
| Solvent strength | + | 0 | 0 | 0 | 0 | + | – |
| Chemical strength | + | + | + | + | + | + | + |
| Impact strength | + | + | + | + | 0 | + | + |

(1) Normal thickness range - Much more thicker films can be used with some materials.
The meanings of the symbols:
+ Generally preferable/acceptable
0 Sometimes preferable/acceptable
– Generally not preferable/acceptable

OBJECTS AND SUMMARY OF THE INVENTION

It is an object of the present invention to provide and new and improved method for preparing more resistant coatings having desired property or properties simultaneously.

It is another object of the present invention to provide a new and improved roll having a more wear resistant coating and desired properties simultaneously.

It is another object of the present invention to provide a new and improved roll and method for coating a roll in which the drawbacks of the prior art are overcome so that a thick coating of specialty plastics can be prepared on a roll.

In the method in accordance with the present invention, the coating is carried out with spraying a plastic onto the outer face of a roll by using hypersonic plasma. A plasma spray system is provided in which a plasma flame having a hypersonic velocity is formed. The plasma flame is directed toward a surface of a roll to be coated. A powder comprising particles of a thermo-plastic or specialty plastic is introduced into the hypersonic plasma flame to form a coating on the surface of the roll.

In preferred embodiments of the method, the plasma flame is provided with a heat energy of from about 50 kW to about 250 kW or atmospheric hypersonic plasma is used as the plasma flame and provided with a heat energy of about 100 kW. The powder of specialty plastic may be provided with an amorphous or crystalline component of specialty plastic. This component of specialty plastic is preferably selected from the group consisting of polyamide-imide (PAI), polyether-imide (PEI), polyetherketone (PEK), polyetheretherketone (PEEK), polyethersulphone (PES), polyimide (PI), polymethacryl-imide (PMI), polyphenylensulfide (PPS), polysulphone (PSU) and mixtures thereof.

Other embodiments of the method in accordance with the invention include the steps of pre-heating the surface of the roll to a temperature from about 20° C. to about 300° C., providing the size of the particles sprayed onto the roll from about 20 μm to about 100 μm and spraying the powder onto the surface of the roll until the thickness of the coating on the roll is from about 200 μm to about 10 mm. A spray pattern of the plasma flame on the surface of the roll can be narrowed by feeding the powder particles directly into the center of the plasma flame. Also, particles of a second material can be fed into the plasma flame simultaneously with the step of feeding the plastic powder particles into the plasma flame such that properties of said coating are affected. The position for introducing the powder particles into the plasma flame is preferably selected on the basis of the melting temperature of the powder particles.

The coated roll in accordance with the invention has an outer surface which is coated with a powder comprising a thermo-plastic and/or specialty plastic such that a coating is formed on the outer surface. The coating is applied by a hypersonic plasma spray. In preferred embodiments, the coating has a thickness of from 200 μm to about 10 mm and a degree of crystallization degree from about 0 to about 100%.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 2:
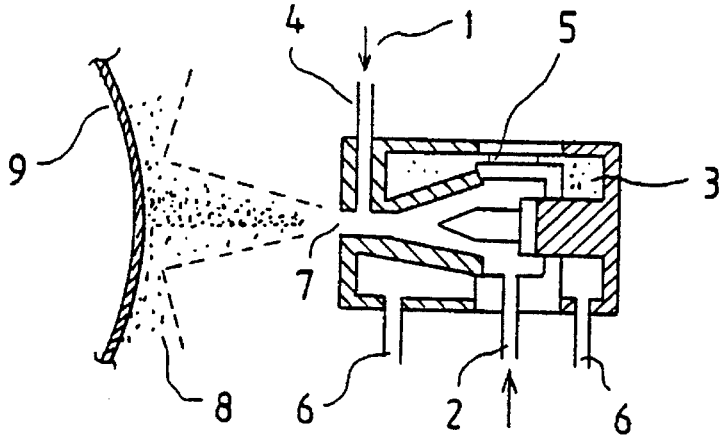
FIG. 2 shows a conventional plasma spray.

FIG. 2 illustrates a conventional plasma spray device in which a powder is fed into the spray system through a passage 1. A gas is fed into the system via a second passage 2. A wolfram cathode is denoted with reference numeral 3 and a copper anode is denoted with reference numeral 4. An intermediate isolation member or part is denoted by reference numeral 5 whereas reference numeral 6 denotes electrical and valve connections. The plasma spray comes out from a passage having an aperture at position 7 and is sprayed in the form of melt particles 8 over a substrate 9. The substrate is thereby coated.

Figure 3:
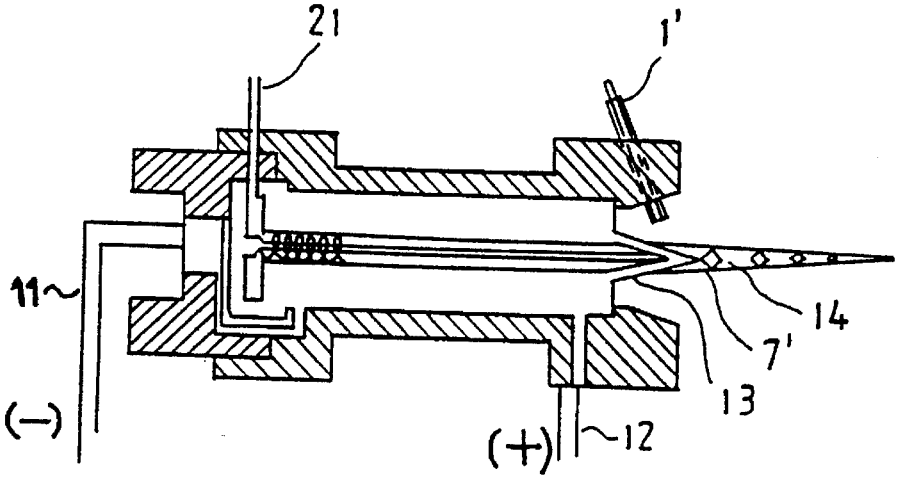
FIG. 3 shows a high effect plasma spray used in a method in accordance with the invention to make a roll in accordance with the invention.

FIG. 3 illustrates a construction of a high effect plasma spray system. In such a plasma spray system, an arc is transferred from an electrode (–) far into a cylindrical nozzle (+). A gas stream forces the arc to the center of the nozzle so that the arc proceeds out from the nozzle and returns to the surface of the output. When the arc extends over about 125 mm, it uses a very high potential of about 500 volt and produces an supersonic high energy plasma spray. The extended plasma arc is well parallelized and retained in a concentrated form for long distances from the nozzle.

With reference to FIG. 3, the theory of an extensive plasma arc is as follows. A high stream 2' of the plasma arc, mainly nitrogen, is fed from an electrode through a gas distributer to a cylindrical nozzle that provides a very strong vortex. A very high DC-potential, e.g., about 600 volt, of the open circuit is used between the nozzle (+) and the electrode (–). The high frequency ignites the spray and the arc transfers from the electrode to the nozzle. A strong gas stream forces the arc to the center of the nozzle so that the arc will extends far out from the nozzle and return to its outer surface because there are no other passages. A very long arc, e.g., over 100 mm, raises the potential very high, up to about 400 volt, and effectively heats the plasma gas to produce a very hot hypersonic plasma spray. A very high potential is easily achieved for the arc with these sprays such,that a very extensive plasma arc is produced. The stream of the arc can be set low in order to be able to use the very high electric effect in the spray.

The hypersonic plasma device designed by Jim Browning consists of only five 15 components which include a water-cooled electrode (–) with gas distribution holes, a water-cooled cylindrical nozzle (+), an isolated space, a front frame for the spray and an isolated back frame. Cooling water is directed into the device from passage 11 and conducted out from the device through passage 12. The plasma spray is denoted with reference numeral 7', the extended arc with numeral 13 and the impact diamond with numeral 14.

The plasma spray is very controlled and centered even at a long distance from the surface of the nozzle. The plasma spray, for example comprising wolfram carbide particles, proceeds straight out of the nozzle more than about one meter and is very concentrated at this distance. The plasma spray appears like a plasma flame in low pressure. More than about 70% of the electric effect fed into the device is transferred to the high gas stream and the rate of the plasma spray becomes supersonic at values over about 3000 m/sec and is observed through protection glasses with impact diamonds 14.

In the coating process, a powder 1' is fed from the output of the nozzle directly to the very hot and extended arc. The addition of hydrogen to the plasma gas further raises the heat energy. Typical values of the energy used are electric effect about 200 kW (400 V×500A)

gas stream about 230 SLM (500 SCFH)

output enthalpy about 35 ×10 $^6$J/kg/15.000 BTU/Lb plasma temperature about 6000° C.

spray rate about 3000 m/sec

For additional details of the device, reference is made to the article "Coatings by 250 kW Plasma Jet Spray System", by T. Morishita, Plazjet Ltd, Tokyo, Japan. (Source: Proceedings of 2nd Plasma Technik Symphosium, Jun. 5–7, 1991, Vol. 1, pp 137–142).

Figure 4:
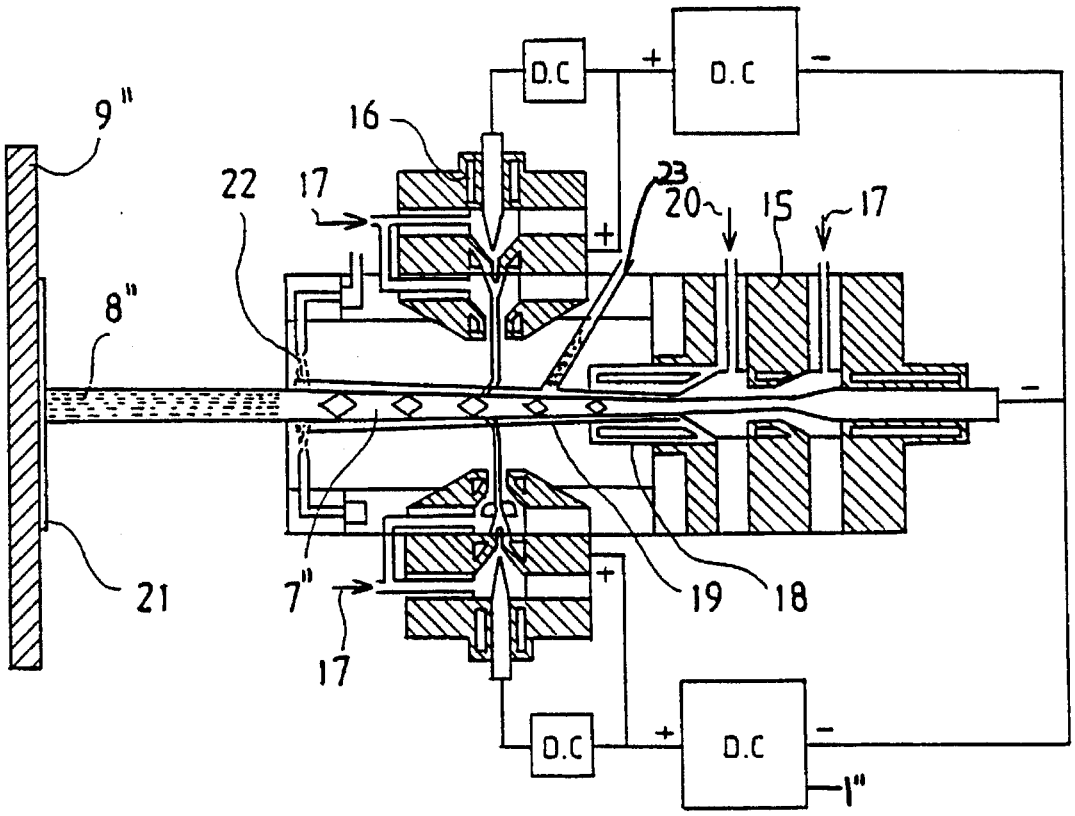
FIG. 4 shows a spraying system using an atmospheric plasma and containing a double anode and which is used in a method in accordance with the invention to produce a roll in accordance with the invention.

FIG. 4 illustrates a construction of a device for spraying atmospheric plasma which comprises a double anode. To stabilize an anode place of the arc, the device is equipped with a cathode jet or torch 15 and two anode jets or torches 16 so that the anode jets are symmetrically arranged as shown in FIG. 4. The operating places of the cathode and anodes are protected with an inert gas such as Ar or $N_2$. In this system, the arc is not instable in any way as any instability could lead to abrasion of the anode place or migration of the anode place or abrasion of the electrodes. Such an instability is a problem in conventional systems. Thus, the spraying conditions can be retained in a stable situation for a long time.

An accelerating nozzle 18 can be loosened and its diameter and length pre-set in order to be appropriate for the plasma spraying. In other words, the rate and temperature of the plasma can be regulated by varying the diameter length and electric effect. This nozzle corresponds to the wearing part of conventional jets. However, such a nozzle does not touch the arc directly and generally there is no need to change it. As shown in FIG. 4, a plasma arc 19 consists of a cathode arc on the axle of the cathode jet and an anode arc on the axle of the anode jet.

A strong cold housing is formed around each arc flame and increases the direction of the arc and the concentration of the heat. Such a stable condition is retained even if the main arc exceeds the sonic speed. The plasma gas that forms the main arc is fed from a place outside the chamber wherein the cathode is protected with inert gas 17 and with air 20. As a result of this arrangement, the rate and enthalpy of the plasma gas can be extensively regulated by the electric effect from about 10 kW to about 100 kW. The plasma spray produced is denoted with reference numeral 7" and is sprayed as particles 8" on a substrate 9" to provide a coating 21. The spraying device is preferably also provided with a plasma cleaning device 22 to maintain a good quality. The powder is introduced into the plasma arc at passage 23.

The electric effect is fed in from position 1". The direct current circuits of the device have also been marked in FIG. 4 (D.C.). The main feed of the electric effect takes place in a larger circuit. For more details of the device, reference is made to the article A. Bunya et al., "New Plasma Spraying System Having Twin Anodes" (Source NTSC 91/Pittsburgh).

Differences between the supersonic or hypersonic plasma device (FIGS. 3 and 4) and a conventional gas plasma apparatus affords some advantages which can be utilized in accordance with the invention in spraying powders of specialty plastics.

Hypersonic plasma methods are used according to the invention in the spraying of powders of specialty plastics whereby the high effect of the plasma device of, for example FIG. 3, is utilized in different forms (200 kW, plasma flame, radiation heat, convection). The pre-heating temperature of the working piece is maintained quite low so that the coating plastic does not burn. This temperature depends on the type of plastic used. In spite of the preheating temperature used, thick layers of a coating of about 200 μm to about 10 mm can be sprayed. Thick coatings will be provided with a correct crystallization degree by means of the method in accordance with the invention so that optimal properties of the plastic are achieved even in such thick coatings. The granule sizes of the powders to be sprayed are from about 20 μm to about 1000 μm.

The rolls to be coated can be variable crown compensated rolls, suction rolls, central rolls and rolls of super calenders and soft calenders.

The melt particles of the hypersonic plasma spray produce coatings of good quality with a large proportion having a high density, good adhesion, a smooth and sprayed surface wherein very little disintegration occurs. The particles that are moving with a supersonic or hypersonic rate produce very dense and non-porous coatings, partly also in a non-melt state.

A given procedure must be followed to produce a hypersonic plasma spray. Plasma sprays can, to some extent, be achieved to a large proportion with a conventional spray by increasing the gas stream and by using a smaller diameter nozzle. However, if the rate of the plasma is increased, it should be noted that the retention time of the powder is shortened at the same time and the heat content may also be increased to melt the powder. In this case, a higher electric effect must be used which is achieved mainly by increasing the arc flow, as a very high potential, e.g., over about 100 V, cannot be achieved with a conventional plasma spray. The threshold of the high electric effect used in a conventional plasma apparatus is about 80 kW. Hypersonic plasma must be used if a higher effect is desired.

Moreover, very high gas streams (even about 30 $m^3$) are used in high effect plasma sprays of the invention used in FIG. 3. In this case, the rate of the out-streaming gas increases up to about 2000 m/sec. The temperature of the plasma flame decreases to about 6000° C. due to the higher flow rate of the gas. Thus, as the exposure temperature and exposure time are lower, less damaging oxidation of the plastic particles occur in the high effect plasma spray than in a conventional plasma spray. In addition, as a result of the higher gas flow rate, the cathode and the anode are at a larger distance from each other so that the potential between the cathode and the anode increases to from about 300 to about 450 volts. Due to a higher potential, the heat energy of the flame can be increased up to about 250 kW. This high heat energy can effectively be used to heat up massive pieces. By comparison, in a conventional plasma spray, the potential between the cathode and anode is increased only by about 10 volts and the heat energy of the flame increased only by about 10 kW.

The heat from the plasma flame radiates in all directions but the heat radiation can be lead onto the surface of the working piece by different cooled mirrors arranged beyond and at the side of the flame in the same way as in the situation in which the light is reflected by a cup in lamps.

Furthermore, the heat effect of the flame can be regulated by appropriately selecting the gases used so that the increase in the flowing rate also raises the heat effect. For example, the heat effect can be raised by use of hydrogen and helium. The heat effect can be decreased in a corresponding way by means of argon.

In a method in accordance with the present invention, the body being coated can be preheated, if desired, but this is not often necessary or even desirable. It is also possible to use a new plasma spraying system that uses atmospheric plasma to produce hypersonic plasma which has double anodes, for example, according to the device shown in FIG. 4.

In another embodiment of the method in accordance with the invention, a powder comprising only particles of a thermo-plastic or specialty plastic is introduced into the hypersonic plasma flame, thereby inherently forming a homogenous and uniform plastic coating on the surface of the roll.

The operating costs of such a roll-coating system in accordance with the present invention can be decreased to less than 50% of those of conventional systems, even if conventionally used materials are used. Thin films of materials, such as $ZrO_2$, with a high melting point can also be produced with this system that sprays atmospheric plasma as such thin films could also be produced by a conventional system that sprays plasma of low pressure. If a cermet material such as WC-Co is used in conventional systems, a very abrasion resistant film can be produced which is comparative to that produced with the above mentioned hypersonic plasma device.

In a preferred embodiment, the double anodes of the device can be heated by effectively feeding the materials to be sprayed directly into the flame center of the plasma arc and the spraying pattern can be made more narrow. Therefore, the efficiency of the plasma spraying in the present invention can be improved so that it is better than in conventional systems. Thus, the invention can also be used for preparing thick coatings by using specialty plastics so as to achieve optimal properties for the coating of the roll.

The properties of the coating can be regulated in the thickness direction of the coating in particular, or in the direction of the roll axle. For example, the elasticity modulus can be regulated by regulating the porosity of the coating between different layers of the coating. If a smaller elasticity modulus is desired, the heat introduction is decreased. The module of elasticity of the coating can be regulated also in the direction of the roll axle, e.g., in ends of the roll, so that there is a different module of elasticity compared with the central region of the roll.

Other additional possibilities for regulating the heat introduction include

- pre-heating of the roll;
- regulation of the flame by
  - regulation of the electric effect,
  - regulation of the amount of the gas, and/or
  - regulation of gas proportions;
- by reflection of the flame; and
- by using outer extra heaters (for example, infra-red (IR) and induction).

Figure 1:
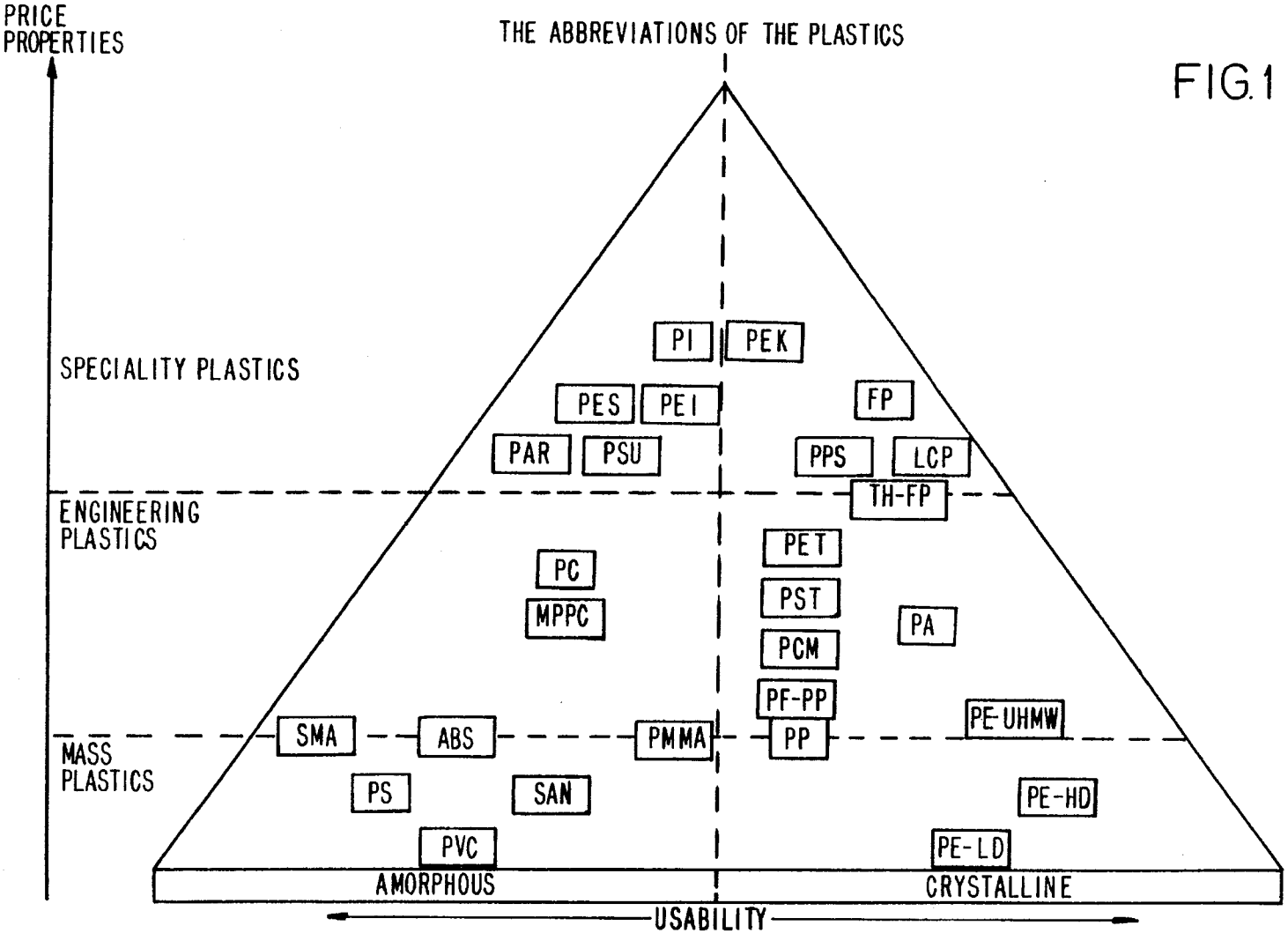
FIG. 1 shows a classification of thermo-setting plastics in standard plastics, engineering plastics and specialty plastic.

Reference is also made to the journal Konepajamies, No. 3, 1991, wherein usable specialty plastics for the invention have been presented (see FIG. 1).

The types of rolls which may be coated by the method in accordance with the present invention include carton and paper machines rolls and paper finishing machines such as: guide rolls, suction rolls, press rolls, central rolls, cylinders, calender rolls, cutting machine rolls, etc.

In another preferred embodiment, the usability of the method of the invention is improved in that coatings of the method of the preparation can be modified by commonly known methods of consolidation of engineering plastics, for example, a so-called Whiskers fiber reinforcing method (the Whiskers fiber is a very little individual crystal fiber) or winding of a continuous fiber (Filament Winding). In particular, the use of the filament winding method enables an effective raise of the peripherential strength of the coating which has special importance when the intention is to achieve higher nip loads in a nip of the paper machine.

Further advantages of the method of the invention include the feature that simultaneous with the spraying of the specialty plastic, other particles, e.g. metal, ceram or cermet particles, can be sprayed. Herewith, the properties of the coating can be affected such as the abrasion strength. Then, the feeding location of these particles to the plasma arc must be selected so that they are directed to the correct location and position in the plasma arc on the basis of their melting temperature.

The problem with the polymer materials is in some cases that the humidity tends to diffuse as a result of the thermal diffusion from the warmer roll surface to the colder body. This means that special requirements are set for the body with respect to the property of corrosion resistance. However, in a preferred embodiment, the roll body can be effectively protected in a method of the invention so that a metallic corrosion resistant layer is sprayed with the same spray as the polymeric coating before the polymeric layer. In this respect, a hypersonic spraying affords a superior advantage compared with conventional methods as the coating becomes very compact and corrosion resistant due to the high rate of the flame. Naturally, some other layer such as an epoxy adhesion layer, can be used as a substrate layer.

Coating materials of the invention have been presented in FIG. 1 and the thickness of the coating is preferably from about 200 μm to about 10 mm.

The examples provided above are not meant to be exclusive. Many other variations of the present invention would be obvious to those skilled in the art, and are contemplated to be within the scope of the appended claims.

What is claimed is:

1. A method for coating a roll of a paper machine with a powder comprising a thermo-plastic and/or specialty plastic, comprising the steps of:

introducing plasma into an interior space of a plasma spray system defined between two oppositely charged electrodes to form a plasma flame having a hypersonic velocity, directing the hypersonic plasma flame toward a surface of a roll to be coated, and introducing a powder comprising only particles of a thermo-plastic and/or specialty plastic into the hypersonic plasma flame to be directed thereby onto the surface of the roll to form a homogenous and uniform plastic coating on the surface of the roll.

2. The method of claim 1, further comprising providing the plasma flame with a heat energy of from about 50 kW to about 250 kW.

3. The method of claim 2, further comprising providing the plasma flame with a heat energy of about 200 kW.

4. The method of claim 1, further comprising utilizing as the plasma flame, atmospheric hypersonic plasma with a heat energy of about 100 kW.

5. The method of claim 1, further comprising providing an amorphous or crystalline component of specialty plastic in the powder introduced into the plasma flame.

6. The method of claim 5, wherein the component of specialty plastic is selected from the group consisting of polyamide-imide (PAI), polyether-imide (PEI), polyetherketone (PEK), polyetheretherketone (PEEK), polyethersulphone (PES), polyimide (PI), poly-methacryl-imide (PMI), polyphenylensulfide (PPS), polysulphone (PSU) and mixtures thereof.

7. The method of claim 1, further comprising pre-heating the surface of the roll to a temperature from about 20° C. to about 300° C.

8. The method of claim 1, further comprising spraying the particles in the plasma flame onto the surface of the roll and providing the size of the particles sprayed onto the roll from about 20 μm to about 100 μm.

9. The method of claim 1, further comprising spraying the particles in the plasma flame onto the surface of the roll until the thickness of the coating on the roll is from about 200 μm to about 10 mm.

10. The method of claim 1, wherein said powder comprises only particles of a specialty plastic.

11. The method of claim 1, further comprising feeding the powder particles directly into the center of the plasma flame.

12. The method of claim 1, further comprising feeding particles of a material into the plasma flame simultaneously with the step of feeding the plastic powder particles into the plasma flame such that properties of said coating are affected, said material being selected from the group consisting of metal, ceram, cermet and mixtures thereof.

13. The method of claim 1, wherein the velocity of the plasma flame is about 2000 m/sec.

14. The method of claim 1, wherein the velocity of the plasma flame is about 3000 m/sec.

* * * * *